US008820847B2

(12) United States Patent
Oddie et al.

(10) Patent No.: US 8,820,847 B2
(45) Date of Patent: Sep. 2, 2014

(54) BLOCK CAVING METHOD

(75) Inventors: Max Edward Oddie, London (GB); Colin Ian Jones, Mid Glam (GB); Pierre Labrecque, Sudbury (CA); Fredric Christopher Delabbio, Samford (AU)

(73) Assignee: Technological Resources Pty. Ltd., Melbourne, Victoria (AU)

( * ) Notice: Subject to any disclaimer, the term of this patent is extended or adjusted under 35 U.S.C. 154(b) by 182 days.

(21) Appl. No.: 13/580,280

(22) PCT Filed: Feb. 22, 2011

(86) PCT No.: PCT/AU2011/000187

§ 371 (c)(1),
(2), (4) Date: Jan. 3, 2013

(87) PCT Pub. No.: WO2011/100808

PCT Pub. Date: Aug. 25, 2011

(65) Prior Publication Data

US 2013/0106165 A1 May 2, 2013

(30) Foreign Application Priority Data

Feb. 22, 2010 (AU) ..... 2010900726
Jun. 8, 2010 (AU) ..... 2010902511

(51) Int. Cl.
*E21C 41/22* (2006.01)

(52) U.S. Cl.
CPC ..... *E21C 41/22* (2013.01)
USPC ..... 299/19

(58) Field of Classification Search
USPC ..... 299/19
See application file for complete search history.

(56) References Cited

U.S. PATENT DOCUMENTS

| | | | | |
|---|---|---|---|---|
| 2,298,599 | A * | 10/1942 | Smith | 299/18 |
| 3,888,543 | A * | 6/1975 | Johns | 299/11 |
| 3,897,107 | A | 7/1975 | Haglund | |
| 2012/0200139 | A1 * | 8/2012 | Delabbio et al. | 299/18 |

OTHER PUBLICATIONS

International Search Report issued by the Australian Patent Office in corresponding International Application No. PCT/AU2011/000187, mailing date May 4, 2011 (2 pages).
International Preliminary Report on Patentability issued by the Australian Patent Office in corresponding International Application No. PCT/AU2011/000187, dated Jan. 3, 2012 (3 pages).
An Overview of Block Caving, http://www.resolutioncopper.com/res/ourapproach/BlockCaveMining.pdf, Nov. 20, 2008 (2 pages).

* cited by examiner

*Primary Examiner* — John Kreck
(74) *Attorney, Agent, or Firm* — Banner & Witcoff, Ltd.

(57) ABSTRACT

A method of block cave mining comprising excavating undercut tunnels (21) at an undercut level; drilling undercut blast holes (25) through the undercut tunnel roofs and setting and detonating explosive charges in those holes to blast rock above the undercut tunnels to initiate the formation of broken rock caverns (26) above the undercut tunnels (21); excavating extraction level tunnels (22) at an extraction level below the undercut level; drilling drawbell blast holes (33) upwardly from the extraction level tunnels at selected drawbell locations toward the broken rock caverns (26) and setting and detonating explosive charges in those holes to blast drawbells (32) through which broken rock falls down into the extraction level tunnels (22); and progressively removing such fallen rock from the drawbell locations through the extraction level tunnels (22); wherein some of the excavation is done mechanically by tunnel boring machinery.

20 Claims, 12 Drawing Sheets

BLOCK CAVING METHOD

CROSS REFERENCE TO RELATED APPLICATION

This application is a national phase application based on PCT/AU2011/000187, filed Feb. 22, 2011, the content of which is incorporated herein by reference.

FIELD OF THE INVENTION

This invention relates to underground mining and has particular application to block and panel caving mines.

BACKGROUND OF THE INVENTION

Block and panel caving is an efficient technique that uses gravity to extract ore from an ore body. Caverns of broken rock are blasted at an upper level (the undercut level) beneath the ore body to be recovered, extraction tunnels are formed at a lower level (the extraction level) beneath the undercut level and a series of relatively narrow drawbells are blasted between the extraction and undercut levels to allow broken cavern rock to fall through the drawbells into the underlying extraction tunnels through which the rock can be removed. The speed of rock falling through the drawbells is controlled by the speed at which rock is removed through the extraction tunnels and as broken rock falls through the drawbells the caverns gradually collapse further to create more broken rock to feed the drawbells under the influence of gravity.

The terms "block caving" and "panel caving" may be used according to the dimensions of the ore body being mined. Specifically the term "panel caving" may be used in relation to the mining of relatively wide and shallow ore bodies. The term "block caving" may be extended to ore bodies which are relatively deep and may be used as a wide or generic term applying to caving beneath any ore bodies and so include within its scope panel caving. The term "block caving" will be used in this broad sense throughout the remainder of this specification, including the claims, and is to be construed as including panel caving within its scope.

In traditional block cave mining excavation at both the undercut and extraction levels is carried out by drilling and blasting and removing the blasted rock to form undercut tunnels at the undercut level and extraction tunnels at the extraction level. This is a slow process and large block cave mines require significant time to develop and a very significant early investment. Both of these factors make their financial success in terms of net present value extremely sensitive to the speed at which they can be brought on stream. The present invention is concerned with methods to enable quicker development of a block cave mine.

SUMMARY OF THE INVENTION

The present invention relates to a method of block cave mining comprising:

excavating undercut tunnels at an undercut level;

drilling undercut blast holes through the undercut tunnel roofs and setting and detonating explosive charges in those holes to blast rock above the undercut tunnels to initiate the formation of broken rock caverns above the undercut tunnels;

excavating extraction level tunnels at an extraction level below the undercut level;

drilling drawbell blast holes upwardly from the extraction level tunnels at selected drawbell locations toward the broken rock caverns and setting and detonating explosive charges in those holes to blast drawbells through which broken rock falls down into the extraction level tunnels; and progressively removing such fallen rock from the drawbell locations through the extraction level tunnels;

wherein some of the excavation is done mechanically by tunnel boring machinery.

At least parts of the extraction level tunnels and/or the undercut level tunnels may be excavated mechanically by tunnel boring machinery. In particular the extraction level tunnels may be developed in a manner which facilitates the use of tunnel boring machinery for rapid development at the extraction level.

The broken rock caverns may be formed across an undercut front which is advanced by continuing cavern formation and the extraction level tunnels may comprise a series of drawbell drifts generally parallel to the advancing undercut front and a series of extraction drifts transverse to and intersecting the drawbell drifts.

The drawbell drifts may extend through said drawbell locations and the drawbell locations may be disposed between the extraction drifts.

The extraction drifts may be oblique to the drawbell drifts so as to extend backwardly and sidewards from the direction of advance of the undercut front to connect with a perimeter extraction drift.

In one method extraction drifts may be extended by tunnel boring machinery in increments equal to the spacing between the drawbell drifts during each excavation of a new drawbell drift.

More specifically each new drawbell drift may be excavated by a tunnel boring machine operated to advance the drawbell drift to an intersection with an extraction drift, to change the boring direction at the intersection to incrementally advance the extraction drift beyond the drawbell drift and to then withdraw into the drawbell drift so that the drawbell drifts and extraction drifts are both extended progressively by successive excavations of generally 'L' shaped or 'hockey stick' shaped tunnel extensions.

In an optional method, the drawbell drifts may be excavated mechanically by tunnel boring machinery and the extraction drifts extended by drilling and blasting. In this optional method, the drawbell drifts may be excavated by tunnel boring machinery sequentially in the direction of advance of the undercut front and the extraction drifts extended incrementally by drilling and blasting between successive drawbell drifts.

Each extraction drift extension may be extended at an obtuse angle to the drawbell drift from which it is advanced.

The drawbell drafts and extraction drifts may be excavated behind the advancing undercut front and the drawbells drilled and blasted beneath rock caverns already formed at the undercut level.

The excavation of the drawbell and extraction drifts may lag the advancing undercut front by at least the distance between the undercut and extraction levels.

BRIEF DESCRIPTION OF THE DRAWINGS

In order that the invention may be more fully explained some specific block cave mining methods employing tunnel boring machinery will be described with reference to the accompanying drawings, in which.

Figure 1:
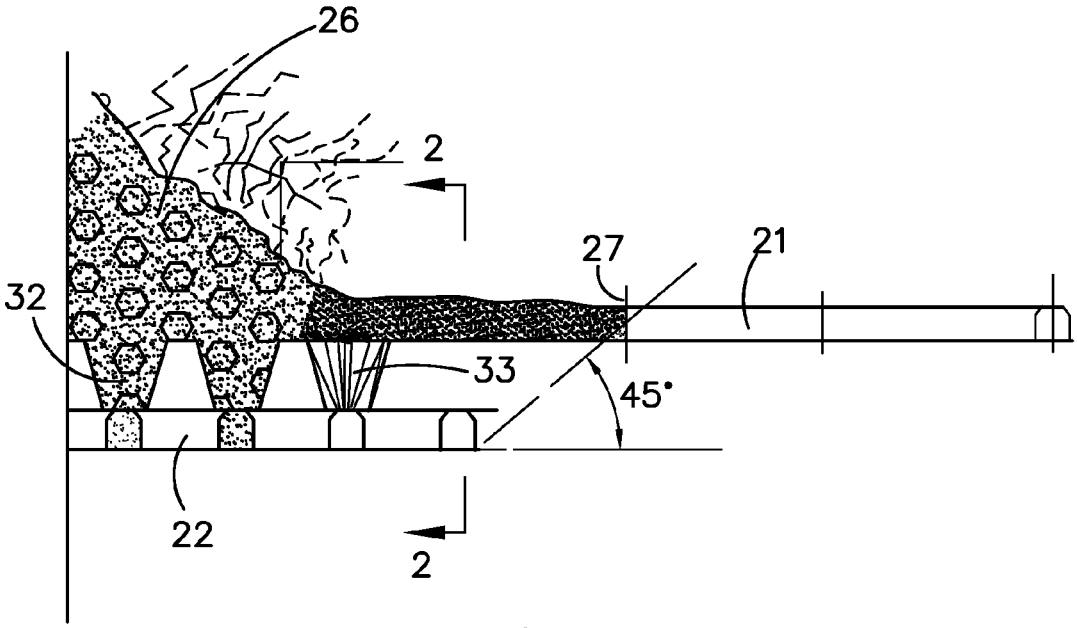
FIG. 1 is a diagrammatic vertical profile of a block caving mine.

The illustrated mine comprises undercut tunnels 21 and extraction level tunnels 22 which are excavated totally or in parts by tunnel boring machines 24 one of which is shown diagrammatically in FIGS. 7 to 12. The tunnels 21 and 22 may be extended from lateral drifts launched from bottom parts of one or more vertical mine shafts extending to the earth's surface above the ore body to be mined. Each of the tunnel boring machines may be assembled from components lowered down the respective mine shaft and assembled in a cavern at a bottom part of the mine shaft or formed at a bottom part of the mine shaft by drilling and blasting and removing material up the shaft in the manner disclosed in Australian patent application 20099030507.

Tunnel boring machines 24 may be of a kind conventionally used in civil engineering tunnelling such as in the formation of road and railway tunnels or water pipe tunnels. They may each comprise a series of linked vehicles mounted on crawler tracks with the lead vehicle provided with a boring head with rotary cutters and the trailing vehicles provided with conveyors to feed excavated material to the rear of the vehicle and to carry ancillary equipment to perform tunnel finishing operations such as rock drilling, bolting and concreting.

The undercut tunnels 21 are extended as a set of parallel tunnels at the undercut level below the ore body to be mined. Undercut blast holes 25 are drilled through the undercut tunnelled roofs so as to extend upwardly and transversely of the undercut tunnels. Explosive charges are set and detonated in holes 25 to blast rock above the undercut tunnels 21 to initiate the formation of broken rock caverns 26 above the undercut tunnels and across an undercut front 27. The undercut front 27 is advanced by a continuing cavern formation, the front advancing back along the undercut tunnels 21. Broken rock formed by blasting and tunnel collapse at this stage of the development is removed through sections of the undercut tunnels not yet affected by blasting. This process promotes the development of the upper caverns of broken rock.

As development of the undercut progresses one of the tunnel boring machines 24 is operated to develop the production ore extraction level tunnels 22 following a pre-undercutting method by the sequence of operations illustrated in FIGS. 3 to 12. In the pre-undercutting method the undercut is completed ahead of development of the production or extraction level. This enables all excavation at the extraction level to be carried out in a low stress region within the stress shadow of the undercut. Drawbells 32 are formed by drilling drawbell blast holes 33 upwardly from the extraction level tunnels 22 at selected drawbell locations toward broken rock caverns already formed at the undercut level and setting and detonating explosive charges in those holes to blast the drawbells 32 through which broken rock falls down into the extraction level tunnels 22.

FIGS. 3 to 12 diagramatically illustrate a development sequence for developing the extraction level tunnels using a tunnel boring machine 24. As shown in these figures the extraction level tunnels 22 comprise series of drawbell drifts 34 generally parallel to the advancing undercut front 27 and a series of extraction drifts 35 transverse to and intersecting the drawbell drifts 34. The drawbell drifts extend through the drawbell locations 32' which are disposed between the extraction drifts 35. Preferably each drawbell location 32' is midway between a pair of extraction drifts. The extraction drifts 35 are oblique to the drawbell drifts 34 so as to extend backwardly and sidewards from the direction of advance of the undercut front 27 and to connect with a perimeter extraction drift 36 so that broken rock can be transported from the drawbells in straight line paths through the extraction drifts to the perimeter drift 36 for recovery from the mine.

The extraction level tunnels 22 comprising drawbell drifts 34 and extraction drifts 35 are located with the low stress undercut zone 40 behind the advancing undercut front 27 and are thus spaced from the high stress abutment zone 41 ahead of the undercut front.

Figure 3:
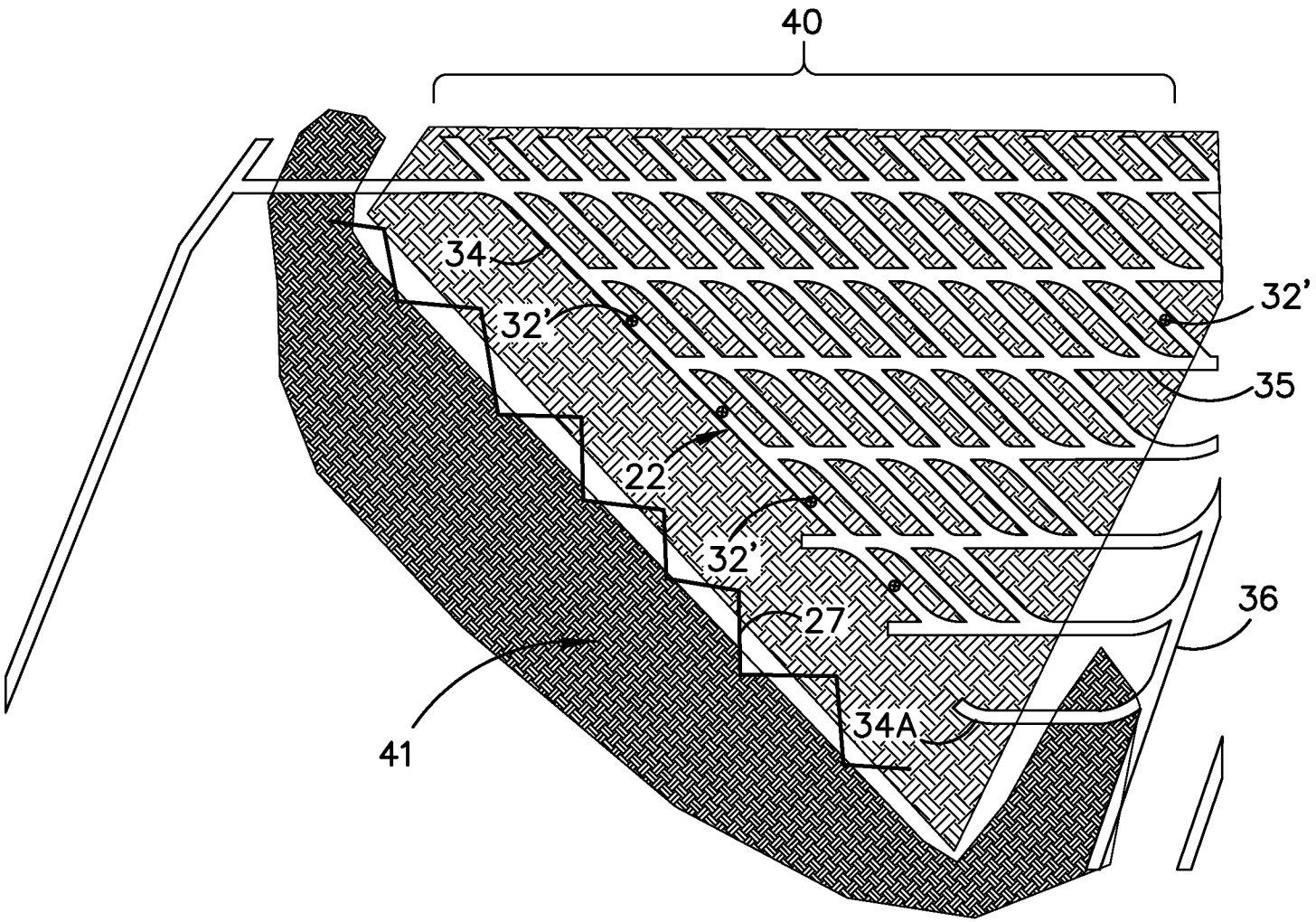
FIGS. 3 to 12 illustrate progressive development of the extraction level tunnels within the mine by tunnel boring machinery.
Figure 4:
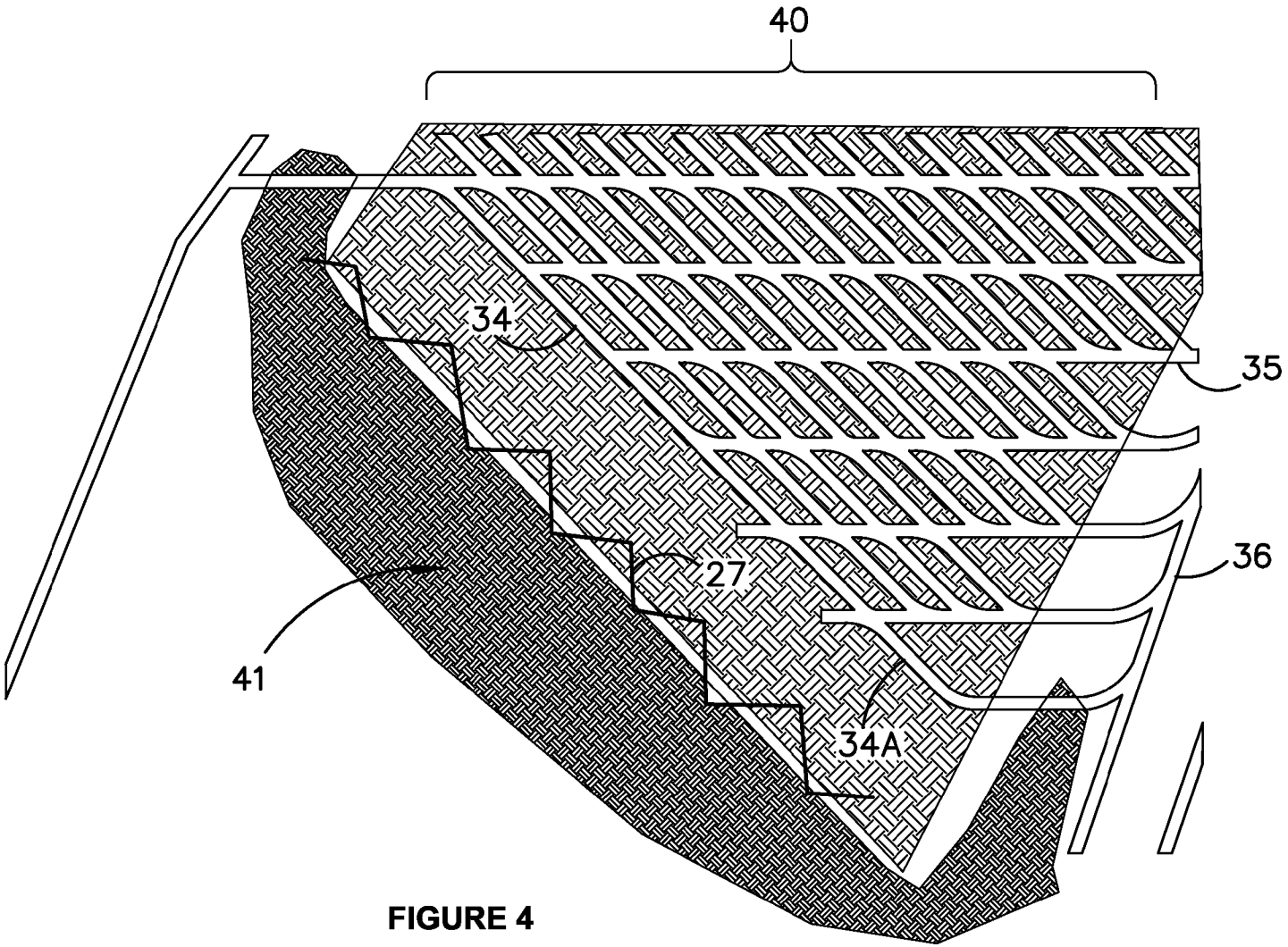
Figure 5:
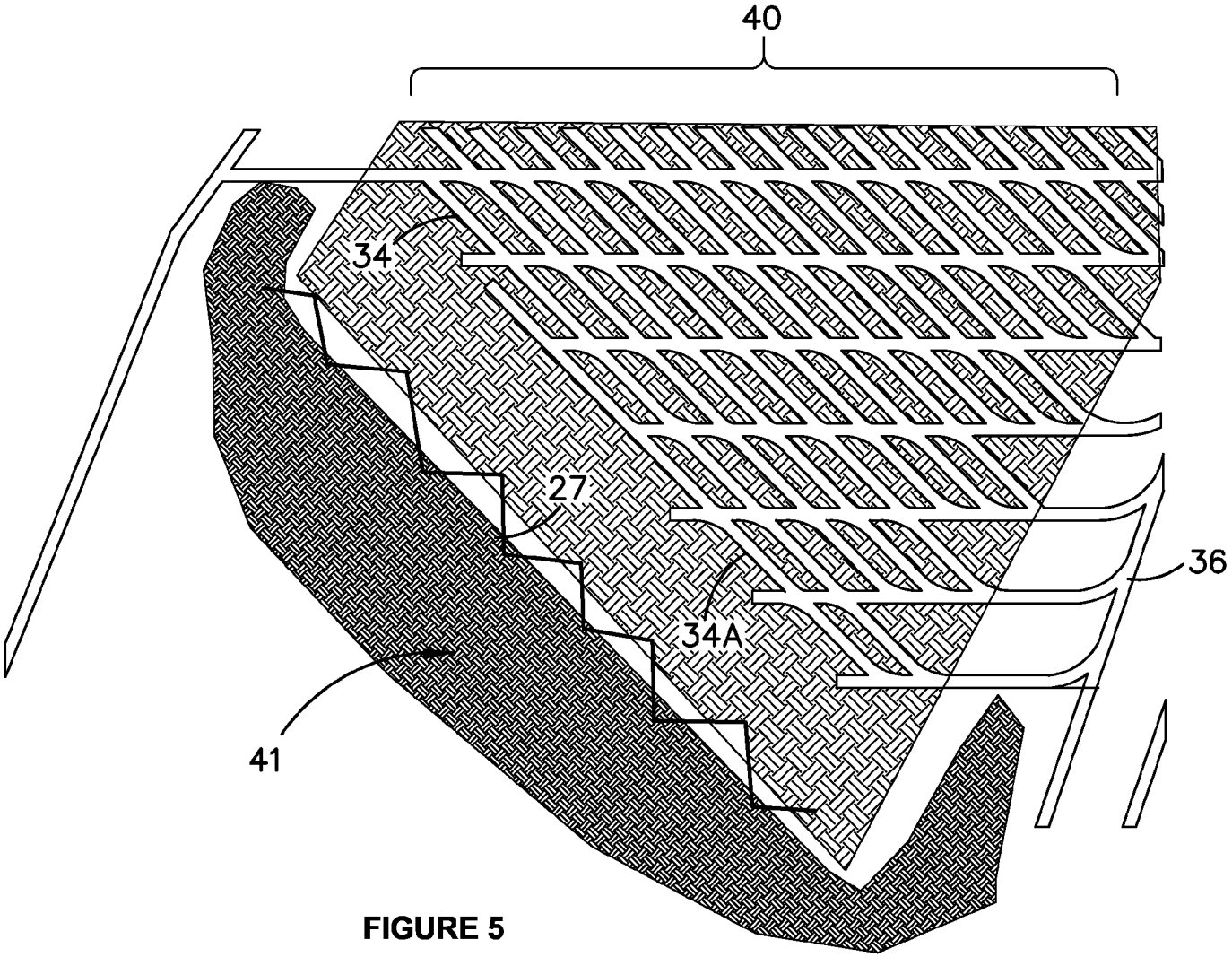
Figure 6:
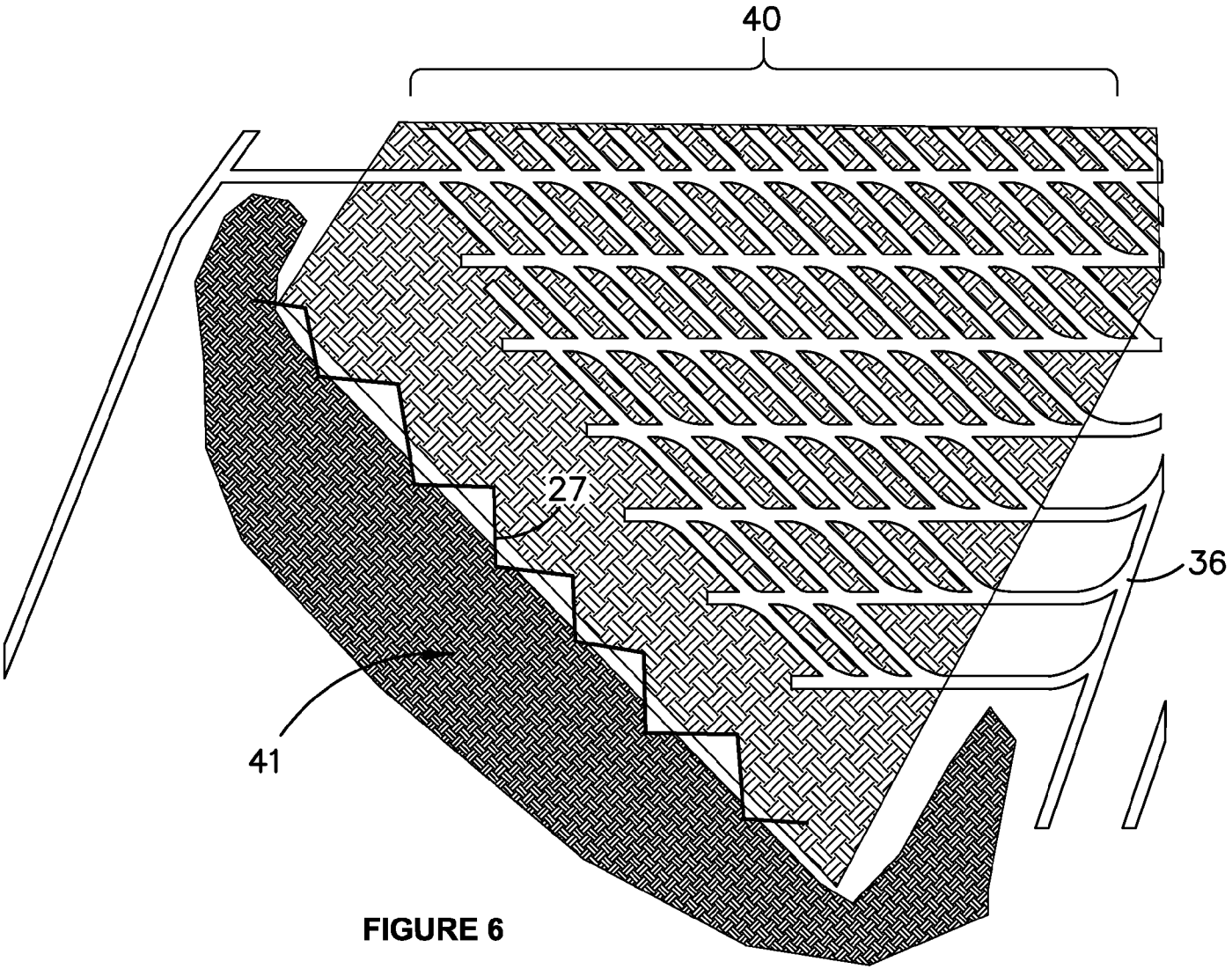

As seen by the development sequence illustrated in FIGS. 3 to 12 the extraction drifts 35 are extended in increments equal to the spacing between the drawbell drifts 34 during each excavation of a new drawbell drift. FIG. 3 shows a new drawbell drift 34A being launched from the perimeter tunnel 36 and FIGS. 4 to 6 show how this new drawbell drift 34A may be developed so as to incrementally advance the extraction drifts. This development involves repeating an excavation cycle illustrated by FIGS. 7 to 11.

Figure 7:
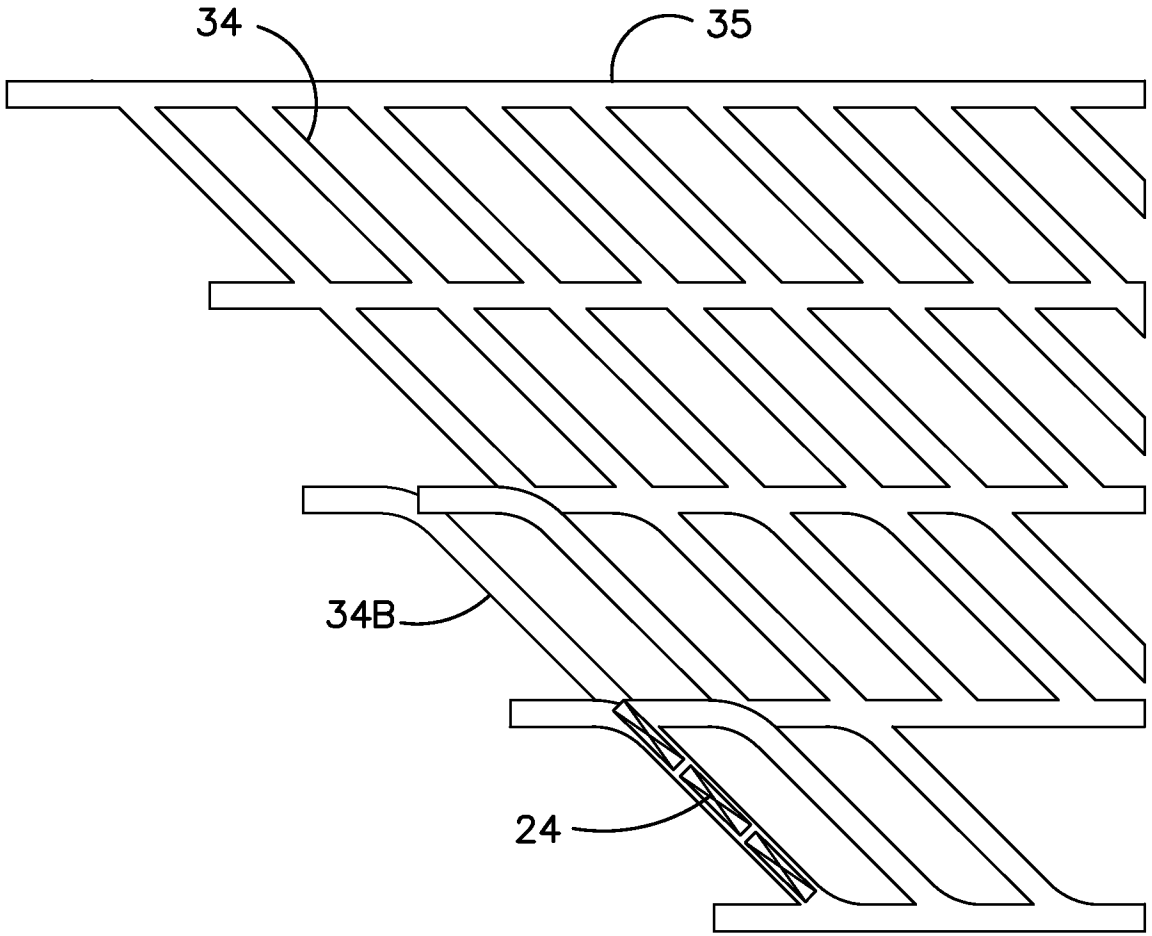
Figure 8:
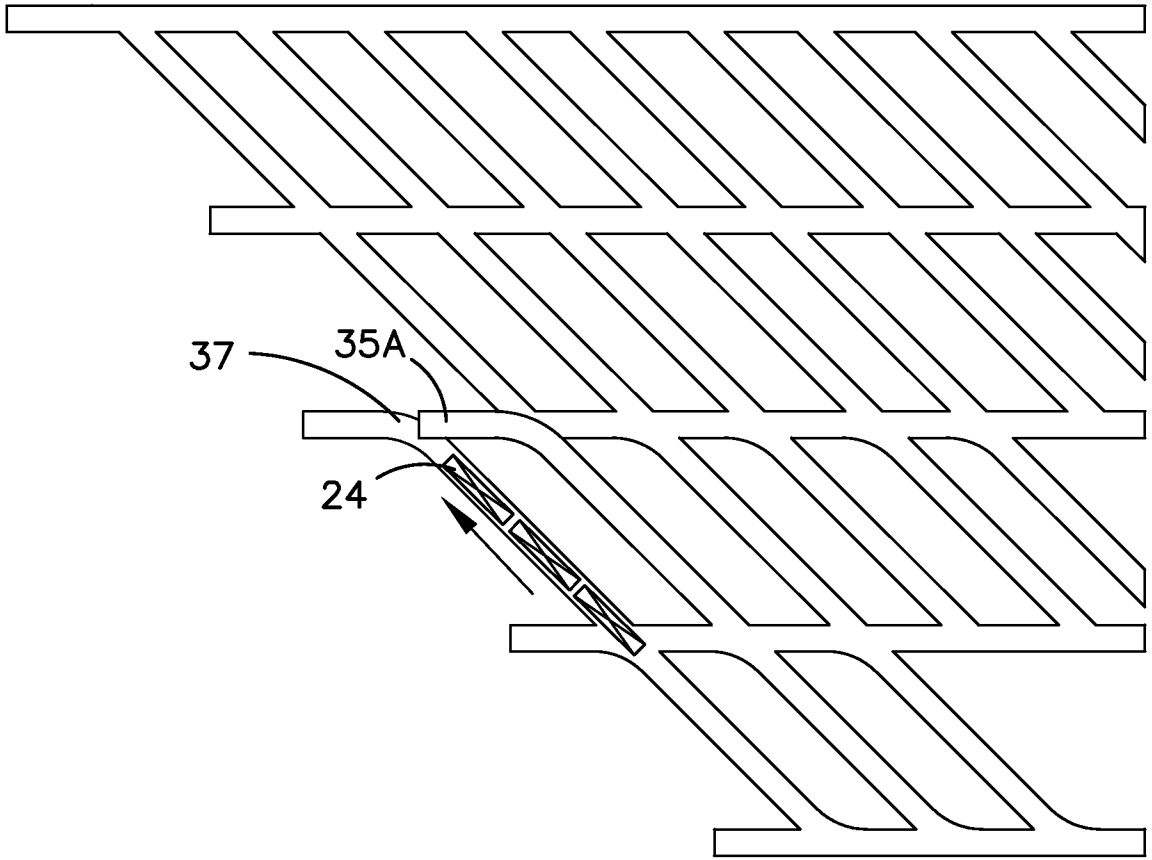
Figure 9:
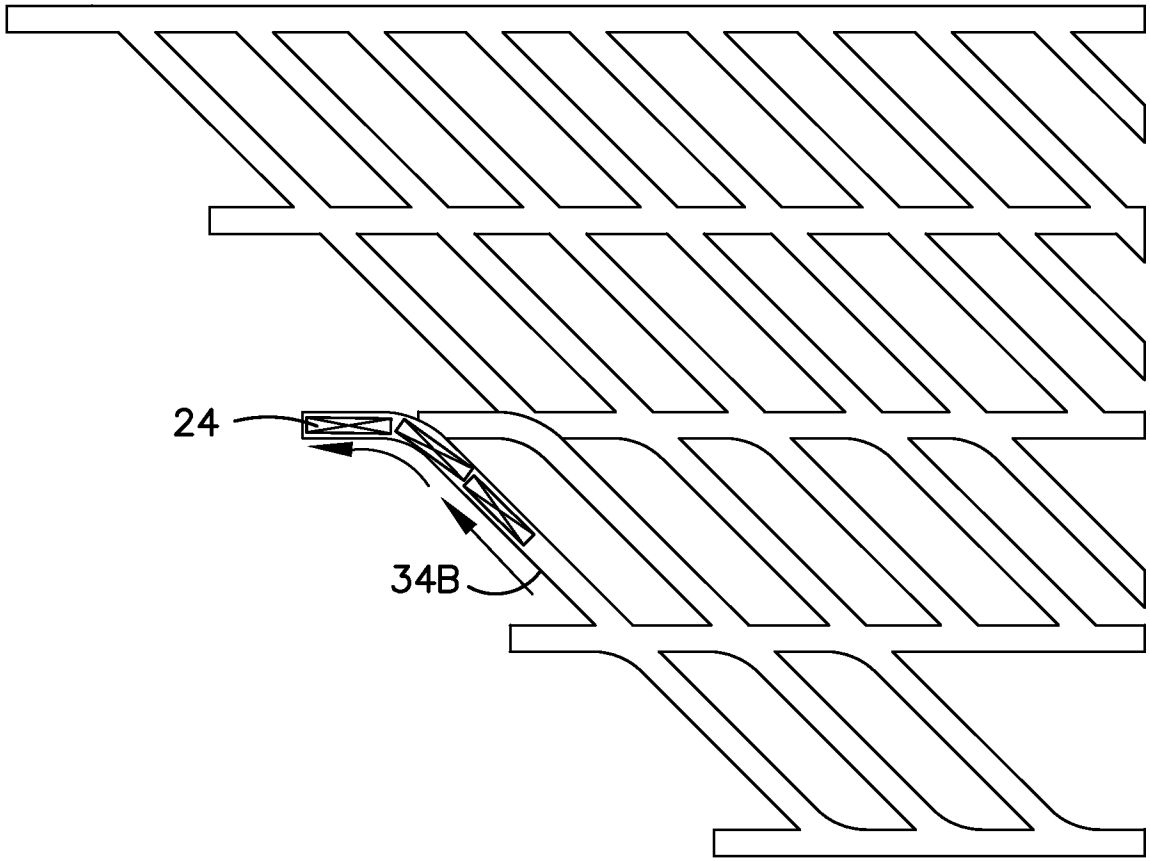
Figure 10:
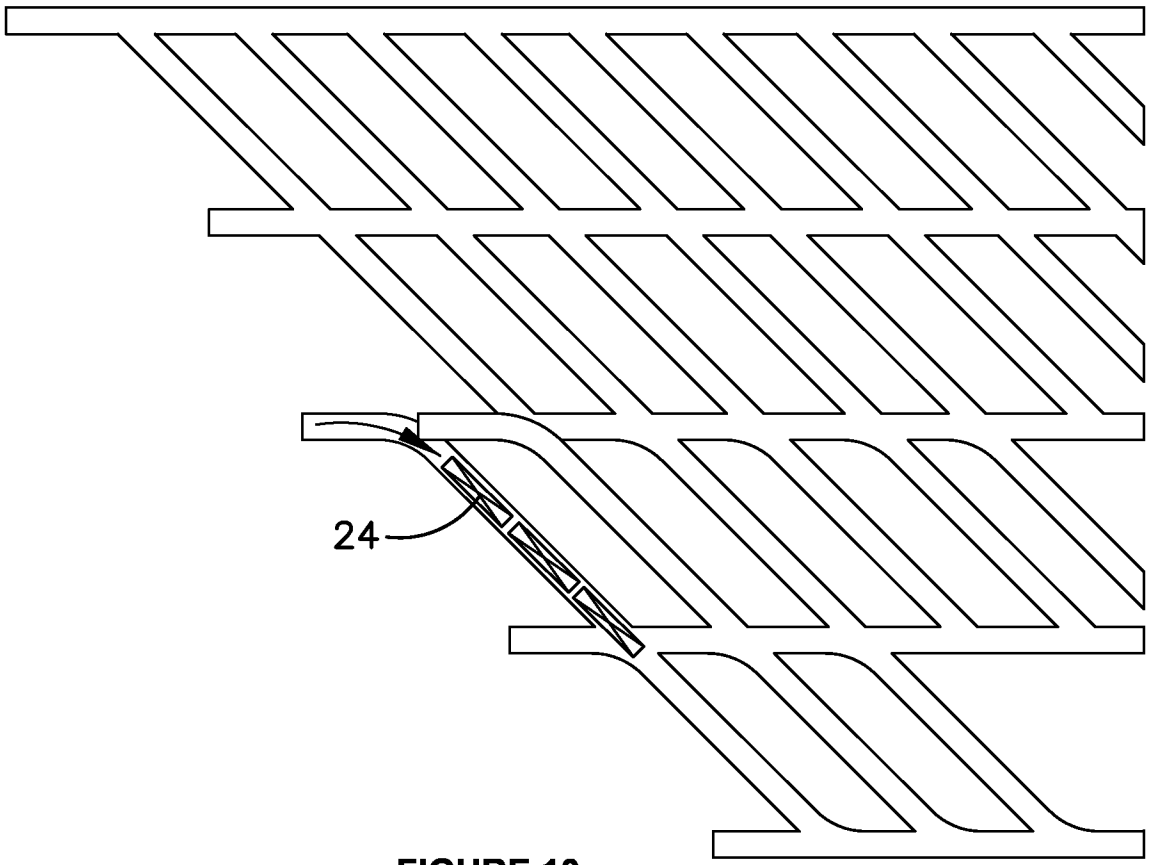
Figure 11:
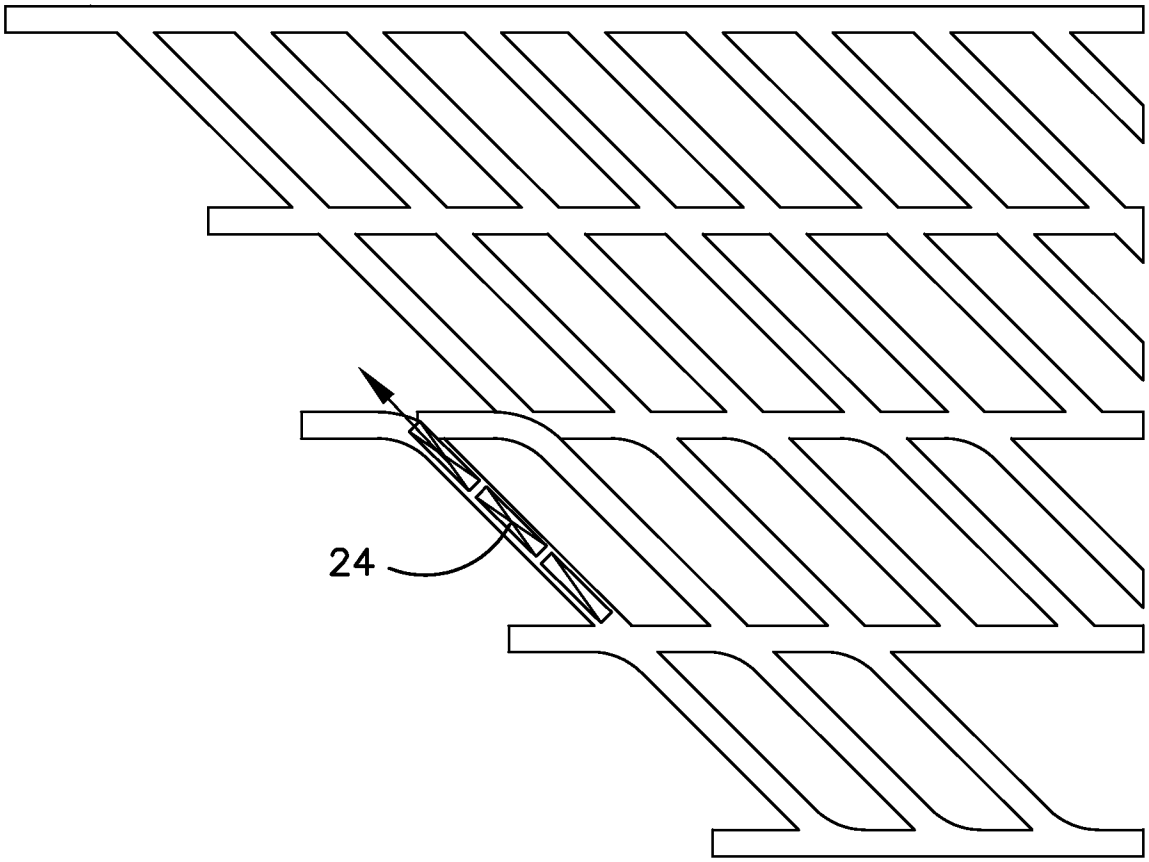

At the start of the cycle shown in FIG. 7 the tunnel boring machine 24 is positioned within the drawbell drift 31A and aligned to excavate an extension 34B of that drawbell drift. FIG. 8 shows the tunnel boring machine cutting the drawbell drift toward an intersection 37 with an extraction drift 35A. At the intersection 37 the boring direction is changed to incrementally advance the extraction drift 35A beyond the drawbell drift through a distance equal to the spacing between the extraction drifts. The tunnel boring machine is then repositioned backwardly into the drawbell drift as shown in FIG. 10 and is then moved forwardly as shown in FIG. 11 so as to extend the drawbell drift towards the next intersection with an extraction drift. In this manner the drawbell drifts and extraction drifts are both extended progressively by successive excavations of generally L-shaped or hockey stick shaped tunnel extensions.

The oblique angle between the drawbell drifts and the extraction drifts may be in the range of 130° to 140°, preferably about 135° to allow manoeuvring of the tunnel boring machine and also the vehicles used for subsequent ore recovery from the drawbells.

Figure 2:
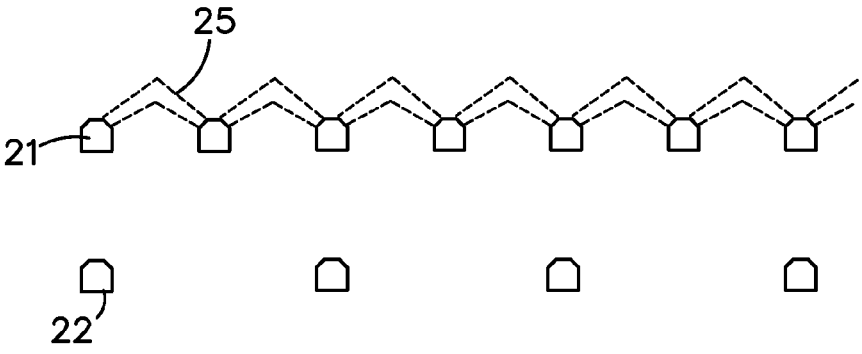
FIG. 2 is a vertical cross section on the line 2-2 in FIG. 1.

The tunnel boring method and development sequence as illustrated in FIGS. 3 to 12 enables rapid development of extraction level tunnels, thus enabling development of the extraction level tunnels at a rate which matches the development of the undercut in a pre-undercutting method in which the extraction level tunnels are completed within the relatively low stress zone beneath the undercut. The horizontal distance by which the excavation of the drawbell and extraction drifts lags the advancing undercut front should preferably be at least the distance between the undercut and extraction levels so as to adhere to a 45° degree rule as indicated in FIG. 2 in order to ensure that tunnelling at the extraction level does not encounter high stress levels which develop within and near the abutment zone 41 adjacent the undercut front. The distance between the undercut and extraction levels may typically be of the order of 15 to 20 meters and the tunnels may be bored to a height or diameter of the order of 3 to 5 meters.

Figure 12:
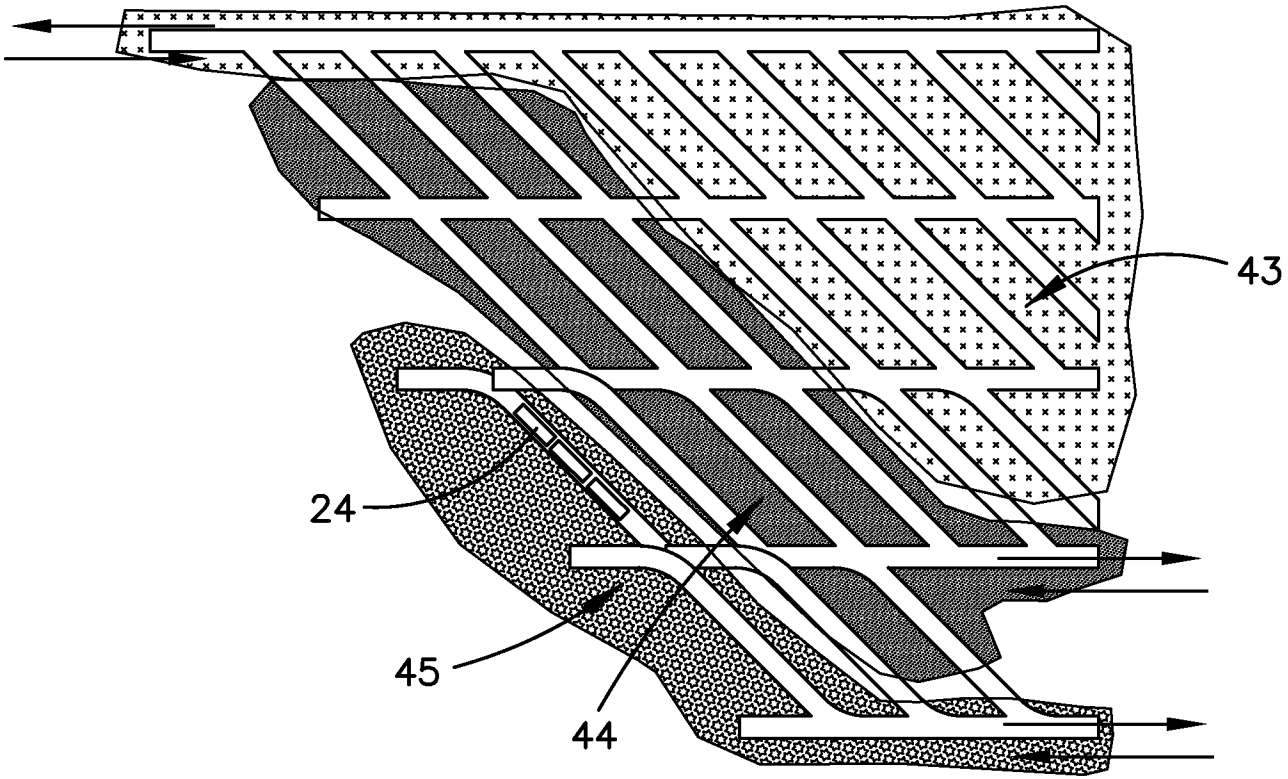

Because the tunnel boring machine is operated in a low stress zone and is far less damaging to the surrounding rock structure than blasting it is possible to excavate the drawbell drifts and extraction drifts at much closer spacing than before, so minimising the dimensions of the pillars between those drifts and the quality of ore loss to production. It is also possible to allow production, construction and development activities to be carried out simultaneously in adjacent zones 43, 44 and 45 as indicated in FIG. 12.

Figure 13:
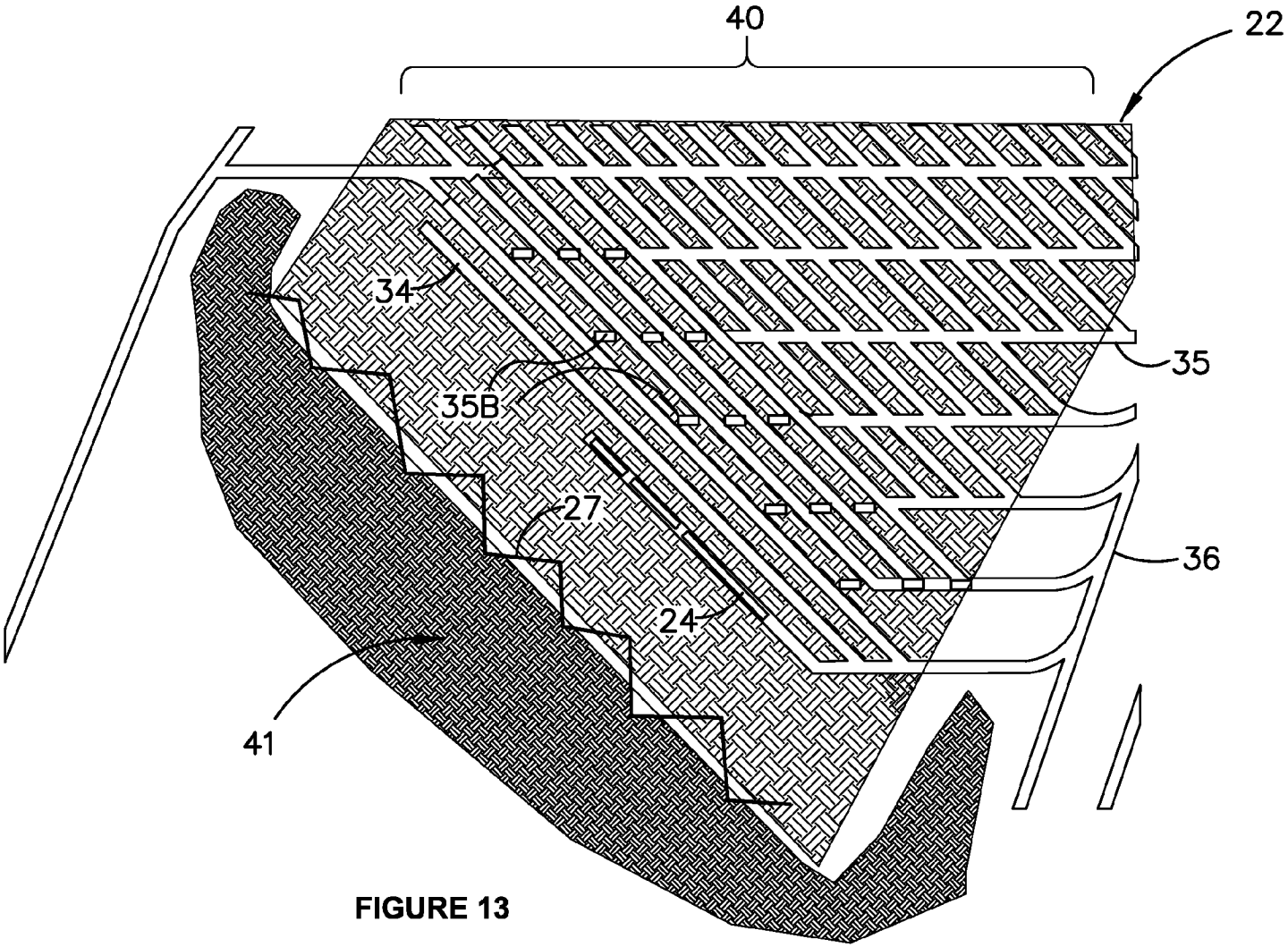
FIG. 13 illustrates development of the extraction level tunnels by an optional method employing both tunnel boring machinery and drilling and blasting.

FIG. 13 illustrates an optional method for developing the extraction level tunnels 22 by a combination of mechanical excavation and excavation by drilling and blasting. As in the previously described method the drawbell drifts are excavated sequentially in the direction of advancement of the undercut front 27 by a tunnel boring machine 24. Whereas in the previous method, the tunnel boring machine was manoeuvred at each intersection with an extraction drift to bore an extension of the extraction drift in the present method the tunnel boring machine is simply operated in a straight line throughout the excavation of each drawbell drift and the extraction drifts are extended by drilling and blasting between successive drawbell drifts as indicated by the broken lines 35B. More specifically, each extraction drift is extended by drilling and blasting between previously excavated successive drawbell drifts.

The tunnel boring machine is operated to excavate one or more drawbell drifts in advance of the previously excavated two or more successive drawbell drifts between which drilling and blasting is carried out. The tunnel boring machine may be operated to excavate a new drawbell drift as drilling and blasting is being carried out between the previously excavated drawbell drifts to extend the extraction drifts.

In the layout shown in FIG. 13 the drawbell drifts are extended from the perimeter drift in groups of three. The tunnel boring machine 24 may be moved into a new linear group of drawbell drifts prior to blasting of the extraction drift extensions between the previously excavated drawbell drifts of the preceding group. In other layouts the drawbell drifts could be connected to the perimeter by a method other than by joining them in groups of three which may affect the extent to which the tunnel boring machine is advanced ahead of the drilling and blasting operations.

The optional method shown in FIG. 13 allows more flexibility of design of operation and may be preferred in some mine locations.

The above described mining methods and equipment enable very significant savings in mine development time. However, these method and equipment have been advanced by way of example only and could be varied. Various kinds of tunnel boring machinery may be employed in a method in accordance with the invention and in some mines this machinery would not need to be assembled at the foot of a mine shaft but could be transported along inclined pathways and tunnels from the mine surface. It is to be understood that these and many other modifications and variations may be made without departing from the scope of the appended claims.

The invention claimed is:

1. A method of block cave mining comprising:

excavating undercut tunnels at an undercut level;

drilling undercut blast holes through the undercut tunnel roofs and setting and detonating explosive charges in those holes to blast rock above the undercut tunnels to initiate the formation of broken rock caverns above the undercut tunnels; excavating extraction level tunnels at an extraction level below the undercut level;

drilling drawbell blast holes upwardly from the extraction level tunnels at selected drawbell locations toward the broken rock caverns and setting and detonating explosive charges in those holes to blast drawbells through which broken rock falls down into the extraction level tunnels; and progressively removing such fallen rock from the drawbell locations through the extraction level tunnels;

wherein at least some of the extraction level tunnels are excavated mechanically by tunnel boring machinery within a stress shadow of the undercut.

2. A method as claimed in claim 1 wherein the broken rock caverns are formed across an undercut front which is advanced by continuing cavern formation.

3. A method as claimed in claim 2 wherein the extraction level tunnels comprise a series of drawbell drifts generally parallel to the advancing undercut front and a series of extraction drifts transverse to and intersecting the drawbell drifts, and the drawbell drifts are excavated by said tunnel boring machinery.

4. A method as claimed in claim 3, wherein the extraction drifts are also excavated by said tunnel boring machinery.

5. A method as claimed in claim 3, wherein the drawbell drifts extend through said drawbell locations and the drawbell locations are disposed between the extraction drifts.

6. A method as claimed in any one of claims 2 to 5, wherein the drawbell drifts and extraction drifts are excavated behind the advancing undercut front.

7. A method of block cave mining comprising:

excavating undercut tunnels at an undercut level;

drilling undercut blast holes through the undercut tunnel roofs and setting and detonating explosive charges in those holes to blast rock above the undercut tunnels to initiate the formation of broken rock caverns above the undercut tunnels;

excavating extraction level tunnels at an extraction level below the undercut level;

drilling drawbell blast holes upwardly from the extraction level tunnels at selected drawbell locations toward the broken rock caverns and setting and detonating explosive charges in those holes to blast drawbells through which broken rock falls down into the extraction level tunnels; and progressively removing such fallen rock from the drawbell locations through the extraction level tunnels;

wherein the broken rock caverns are formed across an undercut front which is advanced by continuing cavern formation, the extraction level tunnels comprise a series of drawbell drifts generally parallel to the advancing undercut front and a series of extraction drifts intersecting the drawbell drifts and oblique to the drawbell drifts so as to extend backwardly and sidewards from the direction of advance of the undercut front, and the drawbell drifts are excavated by tunnel boring machinery.

8. A method as claimed in claim 7, wherein the drawbell drifts extend through said drawbell locations and the drawbell locations are disposed between the extraction drifts.

9. A method as claimed in claim 7 wherein the extraction drifts extend backwardly and sidewards to connect with a perimeter extraction drift.

10. A method as claimed in claim 7 wherein the extraction drifts are extended in increments equal to the spacing between the drawbell drifts during each excavation of a new drawbell drift.

11. A method as claimed in claim 10 wherein a new drawbell drift is excavated by a tunnel boring machine operated to advance the drawbell drift to an intersection with an extraction drift, to change the boring direction at the intersection to incrementally advance the extraction drift beyond the drawbell drift and to then withdraw into the drawbell drift so that the drawbell drifts and extraction drifts are both extended progressively by successive excavations of generally 'L' shaped or 'hockey stick' shaped tunnel extensions.

12. A method as claimed in claim 11 wherein each extraction drift extension is extended at an obtuse angle to the drawbell drift from which it is advanced.

13. A method as claimed in claim 12 wherein said obtuse angle is in the range 130 to 140 degrees.

14. A method as claimed in claim 7, wherein the drawbell drifts are excavated by said tunnel boring machinery sequentially in the direction of advance of the undercut front and the extraction drifts are extended incrementally by drilling and blasting between successive drawbell drifts.

15. A method as claimed in claim 14, wherein the tunnel boring machinery is operated to excavate one or more drawbell drifts at a location or locations in advance of the previously excavated drawbell drifts between which drilling and blasting is being carried out to extend the extraction drifts.

16. A method as claimed in any one of claims 7 to 15, wherein the drawbell drifts and extraction drifts are excavated behind the advancing undercut front.

17. A method as claimed in claim 16 wherein the excavation of the drawbell and extraction drifts lags the advancing undercut front by at least the distance between the undercut and extraction levels.

18. A method as claimed claim 17 wherein the drawbells are drilled and blasted beneath rock caverns already formed at the undercut level.

19. A method as claimed in claim 7 wherein the undercut tunnels comprise a set of parallel tunnels extending in the direction of advance of the undercut front, the undercut blast holes are drilled through the roofs of those tunnels across the undercut front transverse to those tunnels and are blasted by explosive charges to advance the undercut front.

20. A method as claimed in claim 19 wherein the undercut tunnels are excavated by tunnel boring machinery.

* * * * *